US008221186B2

(12) United States Patent
Policaro et al.

(10) Patent No.: US 8,221,186 B2
(45) Date of Patent: Jul. 17, 2012

(54) GARMENT

(75) Inventors: Lina Policaro, Toronto (CA); Jennifer Bernaudo, Woodbridge (CA)

(73) Assignee: Peek-A-Boo Wonderwear, Toronto, Ontario (CA)

( * ) Notice: Subject to any disclaimer, the term of this patent is extended or adjusted under 35 U.S.C. 154(b) by 197 days.

(21) Appl. No.: 12/603,005

(22) Filed: Oct. 21, 2009

(65) Prior Publication Data

US 2010/0105284 A1 Apr. 29, 2010

Related U.S. Application Data

(60) Provisional application No. 61/108,178, filed on Oct. 24, 2008.

(51) Int. Cl.
*A41C 3/00* (2006.01)

(52) U.S. Cl. ..... 450/1; 450/30; 450/86; 2/119; 2/105; 2/106; 2/104

(58) Field of Classification Search ..... 450/1, 28, 450/30, 31–33, 80, 36, 54–58, 86, 88, 82, 450/70–74, 77–79, 63, 35; 2/104, 105, 106, 2/109, 73, 114, 113, 115, 69, 119, 122, 129, 2/133, 46, 50–54, 90, 96
See application file for complete search history.

(56) References Cited

U.S. PATENT DOCUMENTS

| | | | | |
|---|---|---|---|---|
| 2,567,524 | A * | 9/1951 | Morganti | 2/48 |
| 2,707,786 | A * | 5/1955 | Stoner | 2/119 |
| 3,064,265 | A * | 11/1962 | Bridgewaters | 2/74 |
| 3,311,112 | A * | 3/1967 | Murray | 450/1 |
| 3,826,266 | A * | 7/1974 | Alpert | 450/11 |
| 4,754,500 | A * | 7/1988 | Brucato et al. | 2/105 |
| 5,146,626 | A * | 9/1992 | Rosado | 2/105 |
| 6,205,585 | B1 * | 3/2001 | Capparelli | 2/106 |
| 6,935,921 | B1 * | 8/2005 | Eudenbach et al. | 450/54 |
| 7,409,728 | B2 * | 8/2008 | Harry | 2/106 |
| 7,780,502 | B2 * | 8/2010 | Calamari et al. | 450/86 |
| 2007/0281585 | A1 * | 12/2007 | Calamari et al. | 450/1 |
| 2009/0093189 | A1 * | 4/2009 | Frey | 450/1 |

FOREIGN PATENT DOCUMENTS

| | | | |
|---|---|---|---|
| CA | 2080711 | | 10/1993 |
| GB | 2461603 | A * | 1/2010 |
| JP | 2008-15683 | A * | 7/2008 |

* cited by examiner

*Primary Examiner* — Gloria Hale
(74) *Attorney, Agent, or Firm* — Bereskin & Parr LLP/S.E.N.C.R.L., s.r.l.

(57) ABSTRACT

Certain embodiments of the disclosure relate to a garment comprising:

Figure 1:
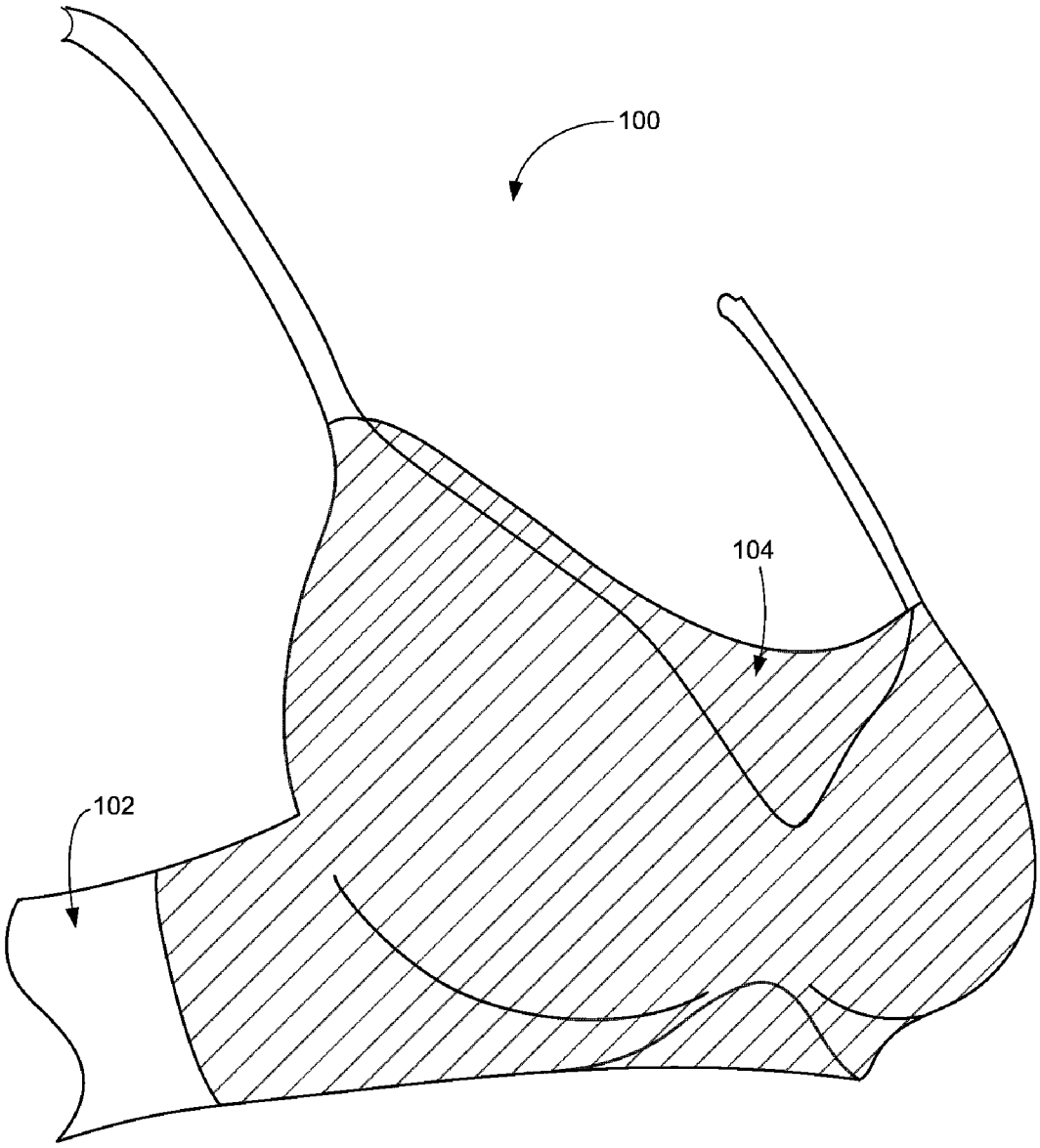

a brassiere comprising a right portion comprising a right support cup and at least one right portion fastener, and a left portion adjacent the right portion and comprising a left support cup and at least one left portion fastener, the left and right support cups being securable to the body of a wearer; and a camisole panel, the camisole panel sized to extend at least between the right support cup and the left support cup and comprising at least one right panel fastener and at least one left panel fastener, the at least one right panel fastener releasably fastenable to the at least one right portion fastener, and the at least one left panel fastener releasably fastenable to the at least one left portion fastener to releasably fasten the camisole panel to the brassiere.

22 Claims, 2 Drawing Sheets

GARMENT

CROSS REFERENCES TO RELATED APPLICATIONS

This application claims priority from U.S. Provisional Patent Application No. 61/108,178, which is incorporated herein by reference in its entirety.

FIELD

The specification relates to garments. Specifically, the specification relates to a camisole panel for a brassiere.

INTRODUCTION

A brassiere is undergarment that generally serves to provide support to the breasts. A brassiere typically includes first and second cups for supporting the breasts. Various configurations of straps, bands, and clasps are known for attaching the cups to the body.

A camisole is an undergarment that can be worn over a brassiere or without a brassiere. Camisoles typically serve to conceal portions of a woman's torso. For example, a camisole may be worn under a low-cut shirt, in order to conceal a brassiere, or to conceal the upper portion of the breasts or chest. A camisole typically includes a tubular body portion for fitting around the torso, and two shoulder straps for securing the camisole to the body.

U.S. Pat. No. 5,171,882 (Heinen) describes a garment having the combined appearance of a brassiere and a camisole. The garment is provided with a camisole top, the brassiere function of the garment being provided by non-stretchable shoulder straps that extend across the interior of the breast cups, and, which are securely connected with the brassiere frames, the shoulder straps extending on a diagonal of the breast cups, portions of the breast cups being reinforced to provide for the support of the weight of the breast.

SUMMARY

The following summary is provided to introduce the reader to the more detailed discussion to follow. The summary is not intended to limit or define the claims.

Camisoles are typically worn to conceal the upper frontal portion of a wearer's torso (e.g. the bustline, a portion of the breasts or chest), or a portion of the wearer's brassiere. However, camisoles do not only cover this portion of the torso, but rather, fit around the entire torso, typically from at least the waist to the axilla, and often include shoulder straps. Due to this design, camisoles can be uncomfortably hot, particularly when worn over a brassiere. Further, although various brassieres have been designed to accommodate various shirt designs, typical camisoles can not be worn with all types of shirts, without detracting form the design of the shirt. For example, some shirts are strapless or are halter-style, and expose the shoulders. With such shirts, a wearer may choose to wear a strapless bra or a halter-style bra. However, if a user wishes to also wear a camisole, the straps of the camisole will show. For further example, some shirts expose the back of a wearer. With such shirts, a wearer may choose to wear a backless bra. However, if a user also wishes to wear a camisole, the back of the camisole will show.

The present application discloses a garment that includes a brassiere, and a camisole panel. The brassiere may be of any design known in the art. The camisole panel generally serves to conceal the upper frontal portion of a wearer's torso, for example the bustline, or a portion of the breasts or chest, or to conceal a portion of the wearer's brassiere, or to provide a decorative effect to the upper frontal portion of a wearer's torso. However, the camisole panel may not be required to fit around the entire torso, or to include straps. Accordingly, the camisole panel can be worn with various shirt designs, and may not be uncomfortably hot. Further, the camisole panel is removably fastenable to the brassiere. Accordingly, a wearer may interchange various designs of the camisole panel on a single brassiere, or may interchange a single camisole panel on various brassieres, or may wear a given brassiere with or without a camisole panel. This may allow for an increased amount of choices of clothing, while reducing costs associated with purchasing multiple brassieres and multiple camisoles.

According to one broad aspect, a garment is disclosed. The garment includes a brassiere comprising a right portion comprising a right support cup and at least one right portion fastener, and a left portion adjacent the right portion and comprising a left support cup and at least one left portion fastener. The left and right support cups are securable to the body of a wearer. The garment further includes a camisole panel. The camisole panel is sized to extend at least between the right support cup and the left support cup. The camisole panel comprises at least one right panel fastener and at least one left panel fastener. The at least one right panel fastener is releasably fastenable to the at least one right portion fastener, and the at least one left panel fastener is releasably fastenable to the at least one left portion fastener to releasably fasten the camisole panel to the brassiere.

In some examples, the right cup has a right cup inner portion and a right cup outer portion, and the left cup has a left cup inner portion adjacent the right cup inner portion, and a left cup outer portion. The camisole panel may be sized to extend at least between the right cup outer portion and the left cup outer portion.

In some further examples, the right cup has a right cup upper portion and a right cup lower portion, and the left cup has a left cup upper portion, and a left cup lower portion. Further, the camisole panel may have a right region and a left region opposed to the right region, and may be sized to extend at least between the right cup upper portion and the right cup lower portion at the right region, and to extend between the left cup upper portion and the left cup lower portion at the left region.

In some examples, the brassiere further comprises a right band extending outwardly from the right cup, a left band extending outwardly from the left cup, a right shoulder strap extending between the right cup and the right band, and a left shoulder strap extending between the left cup and the left band. The at least one right portion fastener may be provided on at least one of the right cup, right band and right shoulder strap. The at least one left portion fastener may be provided on at least one of the left cup, left band and left shoulder strap.

In some examples, the camisole panel comprises an elongate sheet of fabric. The fabric may be selected from the group consisting of lace, satin, silk, cotton, polyester, velvet, acetate acrylic, nylon, spandex, wool, cashmere, rayon, linen, flannel, fleece, and lycra.

In some examples, the at least one right portion fastener comprises a plurality of right portion fasteners. Further, the at least one left portion fastener comprises a plurality of left portion fasteners. The at least one right panel fastener may comprise a plurality of right panel fasteners fastenable to at least some of the right portion fasteners. The at least one left panel fastener may comprise a plurality of left panel fasteners fastenable to h at least some of the left portion fasteners.

In some such examples, the right portion may comprise a right band extending outwardly from the right cup, and the left portion may comprise a left band extending outwardly from the left cup. At least some of the plurality of right portion fasteners may be provided on the right band, and at least some of the plurality of left portion fasteners may be provided on the left band.

In some such examples, the right band has a right band end opposed to the right cup, and the left band has a left band end opposed to the left cup. The right band end and the left band end may be releasably fastenable together to secure the support cups to the body of a wearer.

In some examples, the camisole panel comprises is selectively securable to the brassiere at a different locations on the brassiere to accommodate different body sizes. In some such examples, the right band is provided with first and second right portion fasteners defining an outer right column of fasteners, and third and fourth right portion fasteners defining an inner right column of fasteners adjacent the outer right column. Further, the left band is provided with first and second left portion fasteners defining an outer left column of fasteners, and third and fourth right portion fasteners defining an inner left column of fasteners adjacent the outer left column. The plurality of right panel fasteners may comprise first and second right panel fasteners selectively fastenable to one of the inner right column of fasteners and the outer right column of fasteners, and the plurality of left panel fasteners may comprise first and second left panel fasteners selectively fastenable to one of the inner left column of fasteners and the outer left column of fasteners.

In some examples, the brassiere further comprises a right shoulder strap extending between the right cup and the right band, and a left shoulder strap extending between the left cup and the left band, and the right and left shoulder straps are wearable to secure the right and left support cups to the body of a wearer. In some such examples, at least one of the plurality of right portion fasteners may be provided on the right shoulder strap adjacent the right cup, and at least one of the plurality of left portion fasteners may be provided on the left shoulder strap adjacent the left cup. In other such examples, at least one of the plurality of right portion fasteners is provided on the right cup adjacent the right shoulder strap, and at least one of the plurality of left portion fasteners is provided on the left cup adjacent the left shoulder strap.

In some examples, at least one of the plurality of right portions fasteners is provided below the right cup, and at least one of the plurality of left portion fasteners is provided below the left cup.

In some examples, the brassiere further comprises a gore positioned between the right and left support cups. A gore fastener may be provided on the gore, and the camisole panel may be provided with a central fastener releasably mateable with the gore fastener.

In some examples, the at least one right portion fastener and the at least one left portion fastener each comprise a first side of a hook and an eye fastener, and the at least one right panel fastener and the at least one left panel fastener each comprise a second side of a hook and eye fastener. The first side of the hook and eye fastener and the second side of the hook and eye fastener may be fastenable together to releasably fasten the camisole panel to the brassiere.

In some examples, the at least one right portion faster and the at least one left portion fastener each comprise a first half of a snap fastener, and the at least one right panel fastener and the at least one left panel fastener each comprise a second half of a snap fastener. The first half of the snap fastener and the second half of the snap fastener may be snapable together to releasably fasten the camisole panel to the brassiere.

In some examples, the brassiere is selected from the group consisting of a backless brassiere, a strapless brassiere, a nursing brassiere, an underwire brassiere, a wireless brassiere, a convertible brassiere, an adhesive brassiere, a padded brassiere, a push-up brassiere, a racerback brassiere, a halter-neck brassiere, a training brassiere, a low-back brassiere, and a U-plunge brassiere. Further, the brassiere may be integrally provided with a girdle.

In some examples, the camisole panel comprises an upper portion, and upper portion defines a shape selected from the group consisting of a v-neck, a cowl-neck, a crew-neck, a boat-neck, a square-neck, a round-neck, a sweetheart-neck, and a straight-neck.

In some examples, the right cup has a right cup upper portion, the left cup has a left cup upper portion, and a gap is defined between the right cup upper portion and the left cup upper portion. The camisole panel may be sized to extend across the gap between the right cup upper portion and the left cup upper portion.

In some examples, the brassiere defines a plurality of brassiere edges, the camisole panel defines a plurality of panel edges, and at least some of the panel edges are shaped to align with the brassiere edges.

According to another broad aspect, a garment is provided. The garment comprises a brassiere. The brassiere includes a right portion comprising a right support cup, and a left portion adjacent the right portion and comprising a left support cup. The left and right support cups are securable to the body of a wearer. The garment further comprises a camisole panel. The camisole panel is sized to extend at least between the right support cup and the left support cup. The camisole panel comprises at least one right panel fastener and at least one left panel fastener, the at least one right panel fastener releasably fastenable to the right portion of the brassiere, and the at least one left panel fastener releasably fastenable to the left portion of the brassiere to releasably fasten the camisole panel to the brassiere.

According to another broad aspect, a garment for securing to a brassiere is provided. The brassiere may have a right portion comprising a right support cup and a left portion adjacent the right portion and comprising a left support cup. The garment comprises a camisole panel comprising a right end and a left end. The camisole panel is sized to extend at least between the right support cup and the left support cup of the brassiere. At least one right panel fastener is provided on the right end, and is releasably fastenable to the right portion of the brassiere. At least one left panel fastener is provided on the left end, and is releasably fastenable to the left portion of the brassiere.

According to another broad aspect a brassiere for securing to a garment is provided. The brassiere comprises a right portion comprising a right support cup, and a left portion adjacent the right portion and comprising a left support cup. The left and right support cups are securable to the body of a wearer. At least one right portion fastener is provided on the right portion of the brassiere. The right portion fastener is releasably fastenable to the garment. At least one left portion fastener is provided on the left portion of the brassiere. The left portion fastener releasably fastenable to the garment.

DRAWINGS

Figure 2:
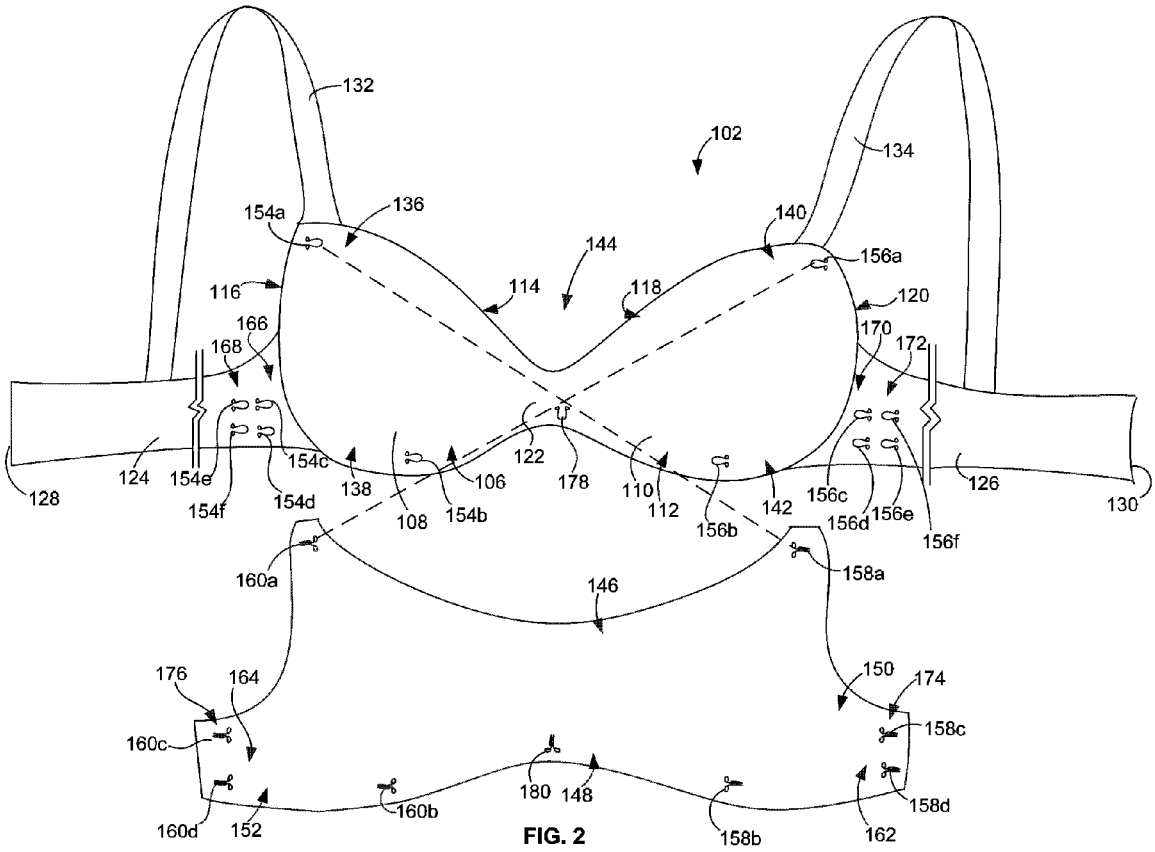

Certain embodiments of the invention will be described in relation to the drawings in which:

FIG. 1 is a partial perspective illustration of an example of a garment, showing a brassiere and a translucent camisole panel; and FIG. 2 is an exploded view of the garment of FIG. 1, showing a front view of the brassiere, and a rear view of the camisole panel.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Referring to FIG. 1, an example of a garment 100 is shown. The garment includes a brassiere 102, and a camisole panel 104.

Referring to FIG. 2, brassiere 102 may be of any design known in the art, and generally includes a right portion 106 comprising a right support cup 108, and a left portion 110 adjacent the right portion and comprising a left support cup 112. It will be appreciated that as used herein, the terms 'right' and 'left' are defined with respect to a wearer. Accordingly, in FIG. 2, wherein a front view of the brassiere is shown, the right portion 106 is shown on the left side of the page. The right 108 and left 112 support cups generally serve to support the breasts of a wearer, and may be securable to the body of a wearer in a number of ways.

For example, as shown in FIGS. 1 and 2, the right 108 and left 112 support cups are securable to the body of a wearer with bands and shoulder straps. That is, the right cup 108 has a right cup inner portion 114, and a right cup outer portion 116, and the left cup 112 has a left cup inner portion 118 and a left cup outer portion 120. The right cup inner portion 114 and the left cup inner portion 118 are joined together by a central fabric portion or gore 122. Further the right portion 106 comprises a right band 124 extending outwardly from the outer portion 116 of the right cup, and the left portion 110 includes a left band 126 extending outwardly from the outer portion 120 of the left cup 112. The right band 124 has a right band end 128 opposed to the right cup 108, and the left band 126 has a left band end 130 opposed to the left cup 112. The right band end 128 and the left band end 130 are releasably fastenable together, around the torso of a wearer, in order to secure the right 108 and left 112 cups to the body of a wearer. For example, the right band end 128 and the left band end 130 may be releasable fastenable together using hook-and-eye fasteners, as is known in the art.

Furthermore, the right cup has a right cup upper portion 136 and a right cup lower portion 138, and the left cup 112 has a left cup upper portion 140 and a left cup lower portion 142. A right shoulder strap 132 is provided which extends between the right cup upper portion 136 and the right band 124, and a left shoulder strap 134 is provided which extends between the left cup upper portion 140 and the left band 130. The right 132 and left 134 shoulder straps are wearable over the shoulders of a wearer and further secure the brassiere 102 to the body of the wearer.

In alternate examples, the right 108 and left 112 support cups may be securable to the body of a wearer in another manner. For example, the brassiere may comprise right 124 and left 126 bands, but may not comprise shoulder straps. Such a brassiere may be referred to as a strapless brassiere. Alternately, only a single unitary band may be provided, which extends from the right cup outer portion 116 to the left cup outer portion 120, and right cup inner portion 114 and left cup inner portion 118 may be releasably fastenable together. Such a brassiere may be referred to as a front-fastening brassiere. In such examples, shoulder straps may or may not be provided. Alternately, bands and/or straps may not be provided, and the right 108 and left 112 cups may be secured to the body of a wearer using adhesives. In such examples, the right 108 and left 112 support cups may or may not be joined together by a central gore. Such a brassiere may be referred to as a backless brassiere and/or an adhesive brassiere. Alternately, the right 124 and left 126 bands may be of increased length, and may be each be configured to extend around the back of a wearer to a lower portion of the wearers back, to cross at the lower portion of the back of the wearer, and to extend back to the front of the wearers body, where the right band end 128 and the left band end 130 may be releasably fastenable together. In such examples, shoulder straps may or may not be provided. Such a brassiere may also be referred to as a low-back brassiere. Alternately, rather than shoulder straps, a neck strap may be used to secure the brassiere to the body of the wearer. Such a neck strap may extend from the right cup upper portion 138, around the rear of the neck of a wearer, to the left cup upper portion 140. Such a brassiere may be referred to as a halterneck brassiere.

In addition to the various methods of securing the brassiere 102 to the body of the wearer, the brassiere may further be of various alternate styles, which are suited for wearing under various types of clothes, or which serve various functions. For example, the brassiere 102 may be a nursing brassiere, a convertible brassiere, a padded brassiere, a push-up brassiere, a racerback brassiere, a training brassiere, or a U-plunge brassiere.

In addition, in any of the above examples, the brassiere may be integrally provided with a girdle or other body-shaping garment.

In addition, in any of the above examples, the brassiere may be provided with or without underwire (i.e. it may be an underwire brassiere, or a wireless brassiere).

In addition, in any of the above examples, various portions of the brassiere may be adjustable. For example, the shoulder straps and/or bands may be adjustable in size and/or length.

Referring to FIGS. 1 and 2, camisole panel 104 is sized to extend at least between the right support cup 108 and the left support cup 112, and is releasably fastenable to the brassiere 102. The camisole panel 104 may serve to conceal the upper frontal portion of a wearer's torso (i.e. the bustline, or a portion of the breasts or chest), to conceal a portion of the brassiere 102, or to provide a decorative effect to the upper frontal portion of a wearer's torso. Accordingly, camisole panel 104 may serve the function of a camisole. However, camisole panel may not necessarily be required to fit around the entire torso, or to include straps. Accordingly, the camisole panel can be worn with various shirt designs, such as backless, halter, strapless, or off-the-shoulder, and various bra designs, as outlined hereinabove, without interfering with the appearance of the shirt. Further, the camisole panel may not be uncomfortably hot. Further, as the camisole panel is removably fastenable to the brassiere, a wearer may interchange various designs of the camisole panel on a single brassiere, or may interchange a single camisole panel on various brassieres, or may wear a given brassiere with or without a camisole panel.

In the example shown, the camisole panel comprises generally an elongate sheet of fabric. In alternate examples, the camisole panel may be integrally provided with another garment, for example a slip, full length camisole, body shaping tank, bodysuit or any other garment. It will be appreciated that although it may be advantageous to provide a camisole panel that does not fit around the entire torso and does not include straps, in some examples, the camisole panel may fit around the entire torso, and may include straps.

It will be appreciated that in FIG. 2, a rear view of the camisole panel is shown. Accordingly, the right region of the camisole panel is on the right side of the page. As such, in order to fasten the camisole panel to the brassiere, the camisole panel would have be flipped over to align with the brassiere.

As previously mentioned, camisole panel 104 is sized to extend at least between the right support cup 108 and the left support cup 112. That is, as shown in FIG. 2, some brassieres may include a dip or gap 144 between the right 108 and left 112 support cups, and particularly between the upper portions 136, 140, of the right 108 and left 112 support cups. A wearer may wish to conceal a portion of their body showing at this dip or gap 144 (for example the bustline, or a portion of the breasts or chest). Accordingly, camisole panel 104 may generally extend across gap 144, between the right support cup 108 and left support cup 112, in order to conceal a portion of the body at the gap 144. For example, camisole panel 104 may be sized to extend at least between the right cup outer portion 116 and the left cup outer portion 120.

In the example shown, camisole panel 104 includes an upper region 146, a lower region 148, and opposed right 150 and left regions 152. The camisole panel 104 is sized to extend between the right cup outer portion 116 and the left cup outer portion 120. That is, the right region 150 is positionable adjacent the right cup outer portion 116, and the left region 152 is positionable adjacent the left cup outer portion 120. Further, the camisole panel 104 is sized such that, at the right region 150, it is extends between the right cup upper portion 136 and the right cup lower portion 138, and at the left region 152, it extends between the left cup upper portion and the left cup lower portion. Further, the upper region 136 is contoured between the right region and the left region, and defines a downwardly extending curve, and the lower region is contoured between the right region and the left region, and defines an upwardly extending curve. Accordingly, in the example shown, the camisole panel 104 extends laterally across gap 144, and longitudinally from a mid point of gap 144 downwards.

In alternate examples, camisole panel 104 may be otherwise sized. For example, camisole panel 104 may be sized to extend laterally between the right cup inner portion 116 and the left cup inner portion 120. Alternately, camisole panel 104 may extend longitudinally from below the right 138 and left 142 cup lower portions to above the right 136 and left 140 cup upper portions.

Furthermore, the upper portion may be contoured in a variety of ways, in order to provide the look of a particular neckline. For example, the upper portion may define a v-neck, a cowl-neck, a crew-neck, a boat-neck, a square-neck, a round-neck, a sweetheart-neck, a straight-neck, or any other neckline known in the art.

Furthermore, the various edges of the camisole panel 104 may be shaped to align with various edges of the brassiere 102. For example, as shown in FIG. 2, the edges at the outer portions 116, 120 of the right 108 and left 106 cups are generally rounded. Accordingly, the edges at the right 150 and let 152 regions of the panel are also rounded, in order to alight with the edges of the brassiere.

Furthermore, the camisole panel 104 may be contoured in order to fit the body of a wearer. For example, the right 150 and left 152 regions of the camisole panel 104 may each be contoured to tightly and snugly overlay cups 108, 112 when worn. That is, the right 150 and left 152 regions of the camisole panel 104 may each define a cup for receiving cups 108 and 112.

As previously mentioned camisole panel 104 is releasably fastenable to the brassiere 102. In some examples, in order to releasably fasten camisole panel 104 to brassiere 102, the right portion 106 of the brassiere comprises at least one right portion fastener 154, and the left portion of the brassiere comprises at least one left portion fastener 156. Further, the right region of the camisole panel comprises at least one right panel fastener 158 releasably fastenable to the at least one right portion fastener 154, and the left region of the camisole panel 104 comprises at least one left panel fastener 160 releasably fastenable to the at least one left portion fastener 156. That is, the right panel fastener(s) 158 is/are releasably fastenable to the right portion fastener(s) 154 to secure the right region 150 of the camisole panel 104 to the brassiere 102, and the left panel fastener(s) 160 is/are releasably fastenable to the left portion fasteners 156 to secure the left region 152 of the camisole panel 104 to the brassiere 102.

In the example shown, the brassiere comprises a plurality of right portion fasteners **154*a*-154*f*, and a plurality of left portion fasteners 156*a*-156*f*. Further, the camisole panel comprises a plurality of right panel fasteners, 158*a*-158*d*, each fastenable to a right portion fastener 154, and a plurality of left panel fasteners 160*a*-160*d*, each fastenable to a left portion fastener 156**.

The fasteners 154, 156 may be provided on the brassiere at a variety of locations and in a variety of configurations. For example, one or more of the right portion fasteners 154 may be provided on the right cup 108, for example on the upper 136 and/or lower 138 portions of the right up, below the right cup 108, for example on a band of fabric extending below the right cup (not shown), on the right band 124, and/or on the right shoulder strap 132, for example adjacent the right cup 108. Further one or more of the left portion fasteners may be provided on the left cup 112, for example on the upper 140 and/or lower 142 portions of the left cup, below the left cup 112, for example on a band of fabric extending below the left cup (not shown), on the left band 126, or on the left shoulder strap 134, for example adjacent the left cup 112. Similarly, the fasteners 158, 168 may be provided on the camisole panel 104 at a variety of locations and in a variety of configurations, in order to fasten with the fasteners 154, 156. Further, as will be described hereinbelow, the fasteners 154-160 may be provided such that the panel 104 is selectively securable at different locations on the brassiere to accommodate different body sizes.

In the example shown, right portion fastener **154*a* is provided on the right cup upper portion 136, adjacent the right shoulder strap 132, and right panel fastener 158*a*, which is fastenable to right portion fastener 154*a*, is provided on the upper 146 and right 150 regions of panel 104. Further, left portion fastener 156***a* is provided on the left cup upper portion 140, adjacent the left shoulder strap 134, and left panel fastener 156*a*, which is fastenable to left portion fastener 156*a*, is provided on the upper 146 and left 152 regions of panel 104. Accordingly, fasteners 154*a*, 156*a*, 158*a*, and 160*a* secure the upper 156 region of panel 104 to brassiere 102. Further, right portion fastener 154*b* is provided on the right cup lower portion 138, and right panel fastener 158*b*, which is fastenable to the right portion fastener 154*b*, is provided on the lower 148 and right 158 regions of panel 104. Further, left portion fastener 156*b* is provided on the left cup lower portion 142, and left panel fastener 156*b*, which is fastenable to left portion fastener 156*b*, is provided on the lower 148 and left 152 regions of panel 104. Accordingly, fasteners 154*b*, 156*b*, 158*b*, and 160*b* secure the lower 148 region of panel 104 to brassiere 102.

As mentioned hereinabove, the fasteners 154-160 may be provided such that the panel 104 is selectively securable at different locations on the brassiere to accommodate different body sizes. For example, as shown in FIG. 2, panel 104 comprises a right panel band 162, and a left panel band 164. Right panel band 162 extends outwardly from right region 150, and is configured to extend partially along right band 124, and left panel band 164 extends outwardly from left region 152, and is configured to extend partially along left band 126. On brassiere 102, right portion fasteners 154*c* and 154*d* are provided on right band 124, and are arranged in an inner column 166 of fasteners. Right portion fasteners 154*e* and 154*f* are also provided on right band 124, and are arranged in an outer column 168 of fasteners, positioned adjacent and outwardly of the inner column 166 of fasteners. Right panel fasteners 158*c* and 158*d* are arranged in a column 174 on right panel band 162, and are selectively fastenable to either the inner column 166 or the outer column 168 of fasteners. Similarly, left portion fasteners 156*c* and 156*d* are provided on left band 126, and are arranged in an inner column 170 of fasteners. Left portion fasteners 156*e* and 156*f* are also provided on left band 126, and are arranged in an outer column 172 of fasteners, positioned adjacent and outwardly of the inner 170 column of fasteners. Left panel fasteners 160*c* and 160*d* are arranged in a column 176 on left panel band 164, and are selectively fastenable to either the inner column 170 or the outer column 172 of fasteners. Accordingly, if a user has a smaller body, or desires a tighter fit, the user may fasten right panel fasteners 158*c* and 158*d* to right portion fasteners 154*e* and 154*f*, and left panel fasteners 160*c* and 160*d* to left portion fasteners 156*e* and 156*f*. Alternatively, if a user desires has a larger body, or desires a looser fit, the user may fasten panel fasteners 158*c* and 158*d* to right portion fasteners 154*c* and 154*d*, and left panel fasteners 160*c* and 160*d* to left portion fasteners 154*c* and 154*d*.

In alternate examples, in order to accommodate different body sizes, inner and outer columns of panel fasteners may be provided on each panel band, 162, 164, and a single column of fasteners may be provided on each band 124, 126. Accordingly, a wearer may selectively fasten either the inner or outer column of each panel band, 162, 164 to the single column on each band, 124, 126 respectively, in order to provide a looser or tighter fit.

In alternate examples, one or more right portion fasteners 154 may be provided on the right band 124, one or more left portion fasteners 156 may be provided on the left band, one or more right panel fasteners 158 may be provided on the right region 150 of the panel 104, and one or more left panel fasteners 160 may be provided on the left region 152 of the panel 104, without being selectively securable.

In the example shown, brassiere 102 further comprises a gore fastener 178 provided on gore 122, and camisole panel 104 comprises a central fastener 178 releasably fastenable to the gore fastener 178.

The right 154 and left 156 portion fastener(s), and the right 158 and left 160 panel fastener(s) may be any of a variety of releasably fastenable fasteners. For example, as shown, the right 154 and left 156 portion fastener comprise a first side of a hook-and-eye fastener (i.e. the eye), and the right 158 and left 160 panel fastener comprise a second side of the hook-and-eye fastener (i.e. the hook). In alternate examples, the right 154 and left 156 portion fastener may comprise the hook and the right 158 and left 160 panel fastener comprise the eye. In alternate examples, the right 154 and left 156 portion fastener(s), may comprise a first side of a snap fastener (i.e. one of a projection receivable in a recess, and a recess for receiving a projection), and the right 158 and left 160 panel fastener(s) may comprise a second side of the snap fastener (i.e. the other of the projection and the recess). In alternate examples, other fasteners may be used, such as Velcro, buttons, magnets, and zippers.

As mentioned hereinabove, camisole panel 104 generally comprises an elongate sheet of fabric. For example, camisole panel 104 may be fabricated from one or more of lace, satin, silk, cotton, polyester, velvet, acetate acrylic, nylon, spandex, wool, cashmere, rayon, linen, flannel, fleece, and lycra. Further, various decorations may be applied to camisole panel 104, such as sequins, beads, appliqués, etc. Further, the camisole panel 104 may comprise more than one layer. For example, the camisole panel 104 may comprise a lace outer layer, and an inner satin liner.

In the example shown in FIGS. 1 and 2, fasteners 154, 156, are provided on brassiere 102, and fasteners 158, 160 are provided on camisole panel 104. In alternate examples (not shown), fasteners may only be provided on the camisole panel 104. For example, one or more right panel fasteners 158 may be provided on the right region 150 of the panel 104, and one or more left panel fasteners 160 may be provided on the left region 152 of the panel. The right 158 and left 168 panel fasteners may be configured to releasably fasten the camisole panel 104 to a brassiere 103 by engaging existing structures on the brassiere 102. For example, the right 158 and left 160 panel fasteners may be hooks which are positioned to engage the edges of the brassiere 102, or the shoulder straps of brassiere 102. Accordingly, a wearer may use camisole panel 104 with existing brassieres 102.

It will be appreciated that in any of the above examples, a brassiere 102 and a camisole panel 104 may be provided and/or sold together as a kit. Alternately, the camisole panel 104 may be sold alone as a garment for fastening to a brassiere. Alternately, the brassiere 102 may be sold alone as a garment.

Further, in alternate examples, an alternate garment may be provided for removably attaching to brassiere 102. That is, brassiere 102 may be provided with fasteners as described hereinabove, and various garments, which may or may not include a camisole panel, may be attachable to the fasteners. Such garments may include a slip, a full length camisole, a body shaping tank, a bodysuit or any other garment.

In yet further alternate examples, the camisole panel 104 may be removably attachable to a garment other than a brassiere 102. For example, the camisole panel 104 may be removably attachable to a slip, a full length camisole, a body shaping tank, a bodysuit or any other garment.

The invention claimed is:

1. A garment comprising:

a) a brassiere comprising a right portion comprising a right support cup, a right band extending outwardly from the right cup and a plurality of right portion fasteners wherein at least one right portion fastener is provided on the right band, and a left portion adjacent the right portion and comprising a left support cup, a left band extending outwardly from the left cup and a plurality of left portion fasteners wherein at least one left portion fastener is provided on the left band, the left and right support cups being securable to the body of a wearer; and b) a camisole panel, the camisole panel sized to extend at least between the right support cup and the left support cup and comprising a plurality of right panel fasteners and a plurality of left panel fasteners, wherein at least one right panel fastener is releasably fastenable to the at least one right portion fastener provided on the right band, and at least one left panel fastener is releasably fastenable to the at least one left portion fastener provided on the left band to releasably fasten the camisole panel to the brassiere.

2. The garment of claim 1, wherein a) the right cup has a right cup inner portion and a right cup outer portion;

b) the left cup has a left cup inner portion adjacent the right cup inner portion, and a left cup outer portion; and c) the camisole panel is sized to extend at least between the right cup outer portion and the left cup outer portion.

3. The garment of claim 2, wherein a) the right cup has a right cup upper portion and a right cup lower portion;

b) the left cup has a left cup upper portion, and a left cup lower portion;

c) the camisole panel has a right region and a left region opposed to the right region; and d) the camisole panel is sized to extend at least between the right cup upper portion and the right cup lower portion at the right region, and to extend between the left cup upper portion and the left cup lower portion at the left region.

4. The garment of claim 1, wherein:

a) the brassiere further comprises a right band extending outwardly from the right cup, a left band extending outwardly from the left cup, a right shoulder strap extending between the right cup and the right band, and a left shoulder strap extending between the left cup and the left band;

b) the at least one right portion fastener is provided on at least one of the right cup, right band and right shoulder strap; and c) the at least one left portion fastener is provided on at least one of the left cup, left band and left shoulder strap.

5. The garment of claim 1, wherein a) the plurality of right panel fasteners are mateable with at least some of the right portion fasteners; and b) the plurality of left panel fasteners are mateable with at least some of the left portion fasteners.

6. The garment of claim 1, wherein a) the right band has a right band end opposed to the right cup;

b) the left band has a left band end opposed to the left cup;

c) the right band end and the left band end are releasably fastenable together to secure the support cups to the body of a wearer.

7. The garment of claim 1, wherein a) the right band is provided with first and second right portion fasteners defining an outer right column of fasteners, and third and fourth right portion fasteners defining an inner right column of fasteners adjacent the outer right column;

b) the left band is provided with first and second left portion fasteners defining an outer left column of fasteners, and third and fourth right portion fasteners defining an inner left column of fasteners adjacent the outer left column;

c) the plurality of right panel fasteners comprises first and second right panel fasteners selectively fastenable to one of the inner right column of fasteners and the outer right column of fasteners; and d) the plurality of left panel fasteners comprises first and second left panel fasteners selectively fastenable to one of the inner left column of fasteners and the outer left column of fasteners.

8. The garment of claim 7, wherein:

a) the brassiere further comprises a right shoulder strap extending between the right cup and the right band, and a left shoulder strap extending between the left cup and the left band, and the right and left shoulder straps are wearable to secure the right and left support cups to the body of a wearer;

b) at least one of the plurality of right portion fasteners is provided on the right shoulder strap adjacent the right cup; and c) at least one of the plurality of left portion fasteners is provided on the left shoulder strap adjacent the left cup.

9. The garment of claim 7, wherein:

a) the brassiere further comprises a right shoulder strap extending between the right cup and the right band, and a left shoulder strap extending between the left cup and the left band, and the right and left shoulder straps are wearable to secure the right and left support cups to the body of a wearer;

b) at least one of the plurality of right portion fasteners is provided on the right cup adjacent the right shoulder strap; and c) at least one of the plurality of left portion fasteners is provided on the left cup adjacent the left shoulder strap.

10. The garment of claim 9, wherein:

a) at least one of the plurality of right portions fasteners is provided below the right cup; and b) at least one of the plurality of left portion fasteners is provided below the left cup.

11. The garment of claim 10, wherein:

a) the brassiere further comprises a gore positioned between the right and left support cups;

b) a gore fastener is provided on the gore; and c) the camisole panel is provided with a central fastener releasably mateable with the gore fastener.

12. The garment of claim 1, wherein a) the at least one right portion fastener and the at least one left portion fastener each comprise a first side of a hook and an eye fastener;

b) the at least one right panel fastener and the at least one left panel fastener each comprise a second side of a hook and eye fastener; and c) the first side of the hook and eye fastener and the second side of the hook and eye fastener are mateable together to releasably fasten the camisole panel to the brassiere.

13. The garment of claim 1, wherein a) the at least one right portion fastener and the at least one left portion fastener each comprise a first half of a snap fastener;

b) the at least one right panel fastener and the at least one left panel fastener each comprise a second half of a snap fastener; and c) the first half of the snap fastener and the second half of the snap fastener are snapable together to releasably fasten the camisole panel to the brassiere.

14. The garment of claim 1, wherein the brassiere is selected from the group consisting of a backless brassiere, a strapless brassiere, a nursing brassiere, an underwire brassiere, a wireless brassiere, an adhesive brassiere, a padded brassiere, a push-up brassiere, a racerback brassiere, a halter-neck brassiere, a low-back brassiere, and a U-plunge brassiere.

15. The garment of claim 1, wherein the camisole panel comprises an elongate sheet of fabric.

16. The garment of claim 1, wherein the fabric comprises a material selected from the group consisting of lace, satin, silk, cotton, polyester, velvet, acetate acrylic, nylon, spandex, wool, cashmere, rayon, linen, flannel and fleece.

17. The garment of claim 1, wherein the camisole panel comprises an upper portion, and upper portion defines a shape selected from the group consisting of a v-neck, a cowl-neck, a crew-neck, a boat-neck, a square-neck, a round-neck, a sweetheart-neck, and a straight-neck.

18. The garment of claim 1, wherein the camisole panel is selectively securable to the brassiere at a different locations on the brassiere to accommodate different body sizes.

19. The garment of claim 1, wherein a) the right cup has a right cup upper portion, the left cup has a left cup upper portion, and a gap is defined between the right cup upper portion and the left cup upper portion; and b) the camisole panel is sized to extend across the gap between the right cup upper portion and the left cup upper portion.

20. The garment of claim 1, wherein the brassiere defines a plurality of brassiere edges, the camisole panel defines a plurality of panel edges, and at least some of the panel edges are shaped to align with the brassiere edges.

21. A garment for securing to a brassiere having a right portion comprising a right support cup and a right band extending outwardly from the right cup, and a left portion adjacent the right portion and comprising a left support cup and a left band extending outwardly from the left cup, the garment comprising:

a) a camisole panel comprising a right end and a left end, the camisole panel sized to extend at least between the right support cup and the left support cup of the brassiere;

b) a plurality of right panel fasteners provided on the right end, wherein at least one right panel fastener is releasably fastenable to the right band of the brassiere;

c) a plurality of left panel fasteners provided on the left end, wherein at least one left panel fastener is releasably fastenable to the left band of the brassiere.

22. A brassiere for securing to a garment, the brassiere comprising:

a) a right portion comprising a right support cup and a right band extending outwardly from the right cup;

b) a left portion adjacent the right portion and comprising a left support cup and a left band extending outwardly from the left cup, the left and right support cups being securable to the body of a wearer;

c) a plurality of right portion fasteners wherein at least one right portion fastener is provided on the right band, the right portion fasteners releasably fastenable to the garment; and d) a plurality of left portion fasteners wherein at least one left portion fastener is provided on the left band, the left portion fasteners releasably fastenable to the garment.

* * * * *